US008015869B2

(12) United States Patent
Nold, III et al.

(10) Patent No.: US 8,015,869 B2
(45) Date of Patent: Sep. 13, 2011

(54) METHODS AND APPARATUS TO PERFORM PRESSURE TESTING OF GEOLOGICAL FORMATIONS

(75) Inventors: Raymond V. Nold, III, Beasley, TX (US); Alexander F. Zazovsky, Houston, TX (US); Nathan Landsiedel, Houston, TX (US); Nicholas Ellson, Houston, TX (US); Vladimir Vaynshteyn, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 571 days.

(21) Appl. No.: 12/202,868

(22) Filed: Sep. 2, 2008

(65) Prior Publication Data

US 2010/0050762 A1 Mar. 4, 2010

(51) Int. Cl.
*E21B 47/06* (2006.01)

(52) U.S. Cl. ..... 73/152.51

(58) Field of Classification Search ..... 73/152.51
See application file for complete search history.

(56) References Cited

U.S. PATENT DOCUMENTS

| | | | | |
|---|---|---|---|---|
| 3,323,360 | A * | 6/1967 | Nutter | 166/264 |
| 3,871,218 | A | 3/1975 | Louis | |
| 4,353,249 | A * | 10/1982 | Lagus et al. | 73/152.41 |
| 4,392,376 | A | 7/1983 | Lagus et al. | |
| 4,936,139 | A | 6/1990 | Zimmerman et al. | |
| 5,831,156 | A * | 11/1998 | Mullins | 73/152.18 |
| 6,301,959 | B1 * | 10/2001 | Hrametz et al. | 73/152.23 |
| 6,478,096 | B1 * | 11/2002 | Jones et al. | 175/50 |
| 6,986,282 | B2 | 1/2006 | Ciglenec et al. | |
| 7,031,841 | B2 | 4/2006 | Zazovsky et al. | |
| 7,913,557 | B2 * | 3/2011 | Vasques et al. | 73/152.55 |
| 2008/0066535 | A1 | 3/2008 | Vasques et al. | |
| 2010/0024540 | A1 * | 2/2010 | Vasques et al. | 73/152.55 |
| 2010/0050762 | A1 * | 3/2010 | Nold et al. | 73/152.51 |
| 2010/0319912 | A1 * | 12/2010 | Pop et al. | 166/264 |

FOREIGN PATENT DOCUMENTS

| | | |
|---|---|---|
| CN | 1490494 | 9/2003 |
| CN | 101403293 | 11/2008 |

* cited by examiner

*Primary Examiner* — John Fitzgerald

(57) ABSTRACT

Example methods and apparatus to perform pressure testing of geological formations are disclosed. A disclosed example method comprises positioning a testing tool in a wellbore formed in the geological formation, sealing a sample interval around the testing tool, sealing a first guard interval around the testing tool and adjacent to the sample interval, reducing a first pressure in the sample interval, reducing a second pressure in the first guard interval, maintaining a volume of a first chamber fluidly coupled to the sample interval during a time interval, and measuring a plurality of pressure data for a fluid captured in the first chamber during the time interval.

21 Claims, 5 Drawing Sheets

METHODS AND APPARATUS TO PERFORM PRESSURE TESTING OF GEOLOGICAL FORMATIONS

FIELD OF THE DISCLOSURE

This disclosure relates generally to geological formations and, more particularly, to methods and apparatus to perform pressure testing of geological formations.

BACKGROUND

Wells are generally drilled into the ground to recover natural deposits of hydrocarbons and/or other desirable materials trapped in geological formations in the Earth's crust. A well is drilled into the ground and/or directed to a targeted geological location and/or geological formation by a drilling rig at the Earth's surface. Data collected from pressure testing a geological formation can be used to determine one or more properties of the geological formation and/or a formation fluid present in the geological formation.

SUMMARY

Example methods and apparatus to perform pressure testing of geological formations are disclosed. A disclosed example method includes positioning a testing tool in a wellbore formed in the geological formation, sealing a sample interval around the testing tool, sealing a first guard interval around the testing tool and adjacent to the sample interval, reducing a first pressure in the sample interval, reducing a second pressure in the first guard interval, maintaining a volume of a first chamber fluidly coupled to the sample interval during a time interval, and measuring a plurality of pressure data for a fluid captured in the first chamber during the time interval.

A disclosed example downhole tool for pressure testing a geological formation includes first and second packers to form an inner interval around the testing tool, a third packer to seal a first outer interval around the testing tool adjacent to the inner interval, a first pump to reduce a first pressure in the inner interval, a second pump to reduce a second pressure in the first outer interval, and a pressure gauge to measure a plurality of pressure data for a fluid captured in the inner interval while the second pressure is reduced and a volume of the inner interval is maintained.

Certain examples are shown in the above-identified figures and described in detail below. In describing these examples, like or identical reference numbers may be used to identify common or similar elements. The figures are not necessarily to scale and certain features and certain views of the figures may be shown exaggerated in scale or in schematic for clarity and/or conciseness.

DETAILED DESCRIPTION

The example methods and apparatus disclosed herein use multiple packers to mechanically stabilize a packed and/or sealed-off section of the wellbore (i.e., an inner interval, a sampling interval, etc.) in which pressure testing and/or fluid sampling operations may be performed. By mechanically stabilizing the sampling interval, the pressure buildup characteristics of a geological formation can be more accurately measured, computed and/or otherwise determined. To stabilize the sampling interval, guard intervals are formed on opposite sides of the sampling interval by the use of additional outer packers. The hydraulic pressure in the guard intervals may be controlled and/or maintained to reduce the differential pressure(s) across the inner packer elements that form the sampling interval during, for example, a pressure drawdown and a subsequent pressure buildup test. For example, a low pressure-differential may be maintained across the inner packers. Additionally or alternatively, the difference between the wellbore pressure (i.e., hydrostatic pressure) and the drawdown pressure may be distributed across the guard intervals and the sampling interval to facilitate pressure testing in wellbores having high hydrostatic pressures.

While example methods and apparatus are described herein with reference to so-called "sampling-while-drilling," "logging-while-drilling," and/or "measuring-while drilling" operations, the example methods and apparatus may, additionally or alternatively, be used to perform pressure testing of geological formations during a wireline sampling operation.

Figure 1:
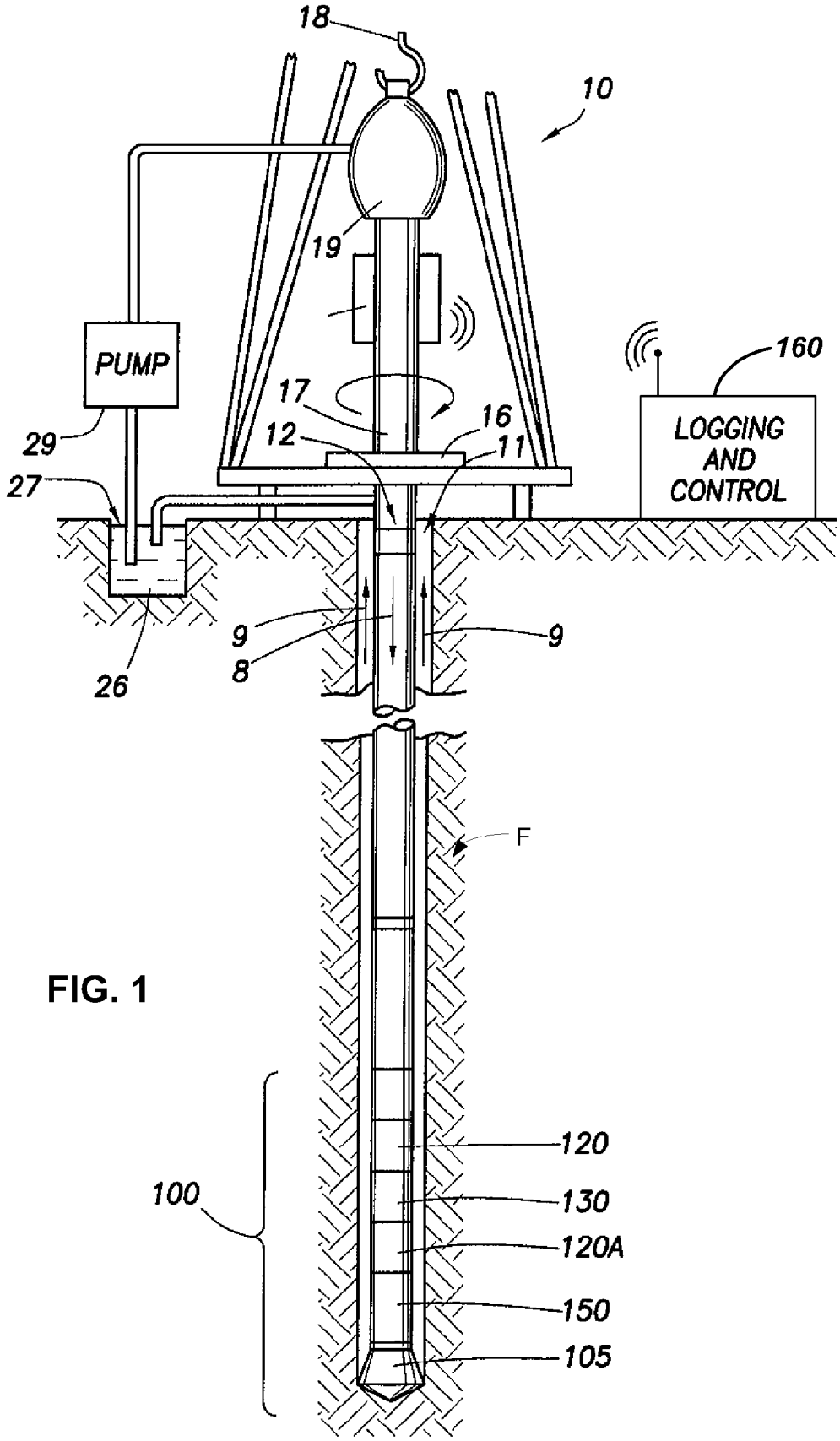
FIG. 1 illustrates an example wellsite drilling system within which the example methods and apparatus described herein may be implemented.

FIG. 1 illustrates an example wellsite drilling system that can be employed onshore and/or offshore. In the example wellsite system of FIG. 1, a borehole 11 is formed in one or more subsurface formations F by rotary and/or directional drilling.

As illustrated in FIG. 1, a drill string 12 is suspended within the borehole 11 and has a bottom hole assembly (BHA) 100 having an optional drill bit 105 at its lower end. A surface system includes a platform and derrick assembly 10 positioned over the borehole 11. The example derrick assembly 10 of FIG. 1 includes a rotary table 16, a kelly 17, a hook 18 and a rotary swivel 19. The drill string 12 is rotated by the rotary table 16, energized by means not shown, which engages the kelly 17 at the upper end of the drill string 12. The example drill string 12 is suspended from the hook 18, which is attached to a traveling block (not shown), and through the kelly 17 and the rotary swivel 19, which permits rotation of the drill string 12 relative to the hook 18. Additionally or alternatively, a top drive system could be used.

In the example of FIG. 1, the surface system further includes drilling fluid or mud 26 stored in a pit 27 formed at the well site. A pump 29 delivers the drilling fluid 26 to the interior of the drill string 12 via a port in the swivel 19, causing the drilling fluid to flow downwardly through the drill string 12 as indicated by the directional arrow 8. The drilling fluid 26 exits the drill string 12 via ports in the drill bit 105, and then circulates upwardly through the annulus region between the outside of the drill string 12 and the wall of the borehole 11, as indicated by the directional arrows 9. The drilling fluid 26 lubricates the drill bit 105, carries formation cuttings up to the surface as it is returned to the pit 27 for recirculation, and creates a mudcake layer on the walls of the borehole 11.

The example BHA 100 of FIG. 1 includes, among other things, any number and/or type(s) of logging-while-drilling (LWD) modules (two of which are designated at reference numerals 120 and 120A) and/or measuring-while-drilling (MWD) modules (one of which is designated at reference numeral 130), a roto-steerable system or mud motor 150, and the optional drill bit 105.

The example LWD modules 120 and 120A of FIG. 1 are each housed in a special type of drill collar, as it is known in the art, and each contain any number of logging tools and/or fluid sampling devices. The example LWD modules 120, 120A include capabilities for measuring, processing, and/or storing information, as well as for communicating with surface equipment, such as a logging and control computer 160 via, for example, the MWD module 130.

An example LWD module 200 having four packers to improve the accuracy and/or conditions in which pressure testing of the geological formation F may be performed is described below in connection with FIG. 2. Example manners of implementing a pressure testing system 220 (FIG. 2) for any of the LWD modules 120, 120A, 200 are described below in connection with FIGS. 3 and 5.

Another example manner of implementing an LWD module 120, 120A is described in U.S. Publication No. 2008/0066535, entitled "Adjustable Testing Tool and Method of Use," published on Mar. 20, 2008, and which is hereby incorporated by reference in its entirety.

The example MWD module 130 of FIG. 1 is also housed in a special type of drill collar and contains one or more devices for measuring characteristics of the drill string 12 and/or the drill bit 105. The example MWD tool 130 further includes an apparatus (not shown) for generating electrical power for use by the downhole system. Example devices to generate electrical power include, but are not limited to, a mud turbine generator powered by the flow of the drilling fluid, and a battery system. Example measuring devices include, but are not limited to, a weight-on-bit measuring device, a torque measuring device, a vibration measuring device, a shock measuring device, a stick slip measuring device, a direction measuring device, and an inclination measuring device.

Figure 2:
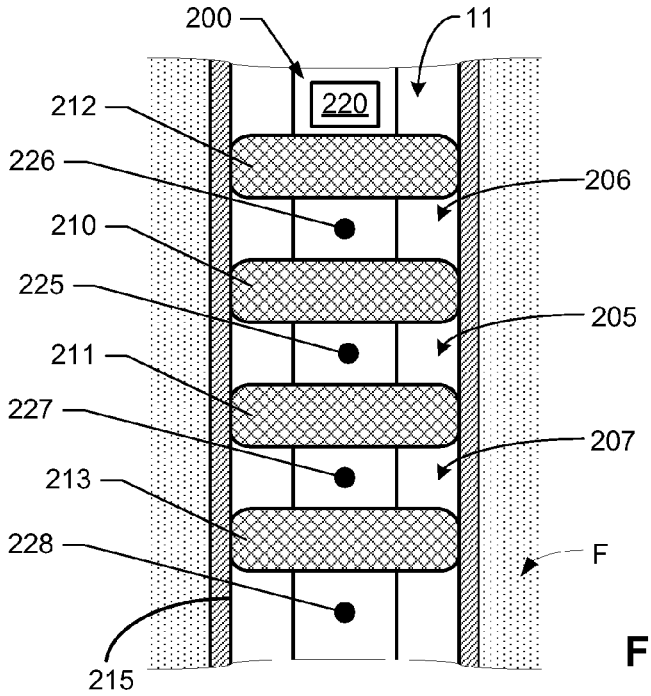
FIG. 2 illustrates an example manner of implementing a logging while drilling (LWD) module for the example wellsite drilling system of FIG. 1.

FIG. 2 is a schematic illustration of an example manner of implementing either or both of the example LWD modules 120 and 120A of FIG. 1. While either of the example LWD modules 120 and 120A of FIG. 1 may be implemented by the example device of FIG. 2, for ease of discussion, the example device of FIG. 2 will be referred to as LWD module 200. The example LWD module 200 of FIG. 2 may be used to perform, among other things, pressure testing of a geological formation F. The example LWD module 200 is attached to the drill string 12 (FIG. 1) driven by the rig 10 to form the wellbore or borehole 11. When the LWD module 200 is part of a drill string, the LWD module 200 includes a passage (not shown) to permit drilling mud to be pumped through the LWD module 200 to remove cuttings away from a drill bit.

To seal off intervals and/or portions 205, 206 and 207 of the example wellbore 11, the example LWD module 200 of FIG. 2 includes packers 210, 211, 212 and 213. The example packers 210-213 of FIG. 2 are inflatable elements that encircle the generally circularly shaped LWD 200. The example intervals 205-207 of FIG. 2 likewise encircle the LWD 200. When inflated to form a seal with a wall 215 of the wellbore 11, as shown in FIG. 2, the example inner pair of packers 210 and 211 form the inner and/or sampling interval 205 in which pressure testing of the geological formation F is performed. Other formation and/or formation fluid tests and/or measurements may also be performed in the inner interval 205. When inflated to form a seal with the wall 215 of the wellbore 11, as shown in FIG. 2, the example outer pair of packers 212 and 213 form respective guard intervals 206 and 207 on respective and/or opposite sides of the inner interval 205. The example packers 210-213 of FIG. 2 have a height of 1.5 feet and a spacing of 3 feet. However, other size packers and/or packer spacing(s) may be used depending on an expected mud filtrate invasion depth, and/or a desired formation fluid cleanup and/or production performance.

To allow the example pressure testing system 220 to be fluidly coupled to the intervals 205-207, the example LWD module 200 of FIG. 2 includes ports 225, 226 and 227 for respective ones of the intervals 205-207. As described below in connection with FIGS. 3-5, the example pressure testing system 220 of FIG. 2 is able to pump fluid from the sample and/or inner interval 205 via the port 225 to perform a cleanup or sampling operation of the sample interval 205 (e.g., lift and/or remove mudcake), and/or to drawdown the pressure in the sample interval 205 and measure subsequent pressure buildup data. The example pressure testing system 220 is also able to draw fluid out of and/or push fluid into the guard intervals 206 and 207 to adjust, control and/or maintain pressure(s) in the guard intervals 206 and 207. In some examples, the pressure testing system 220 reduces the pressure in the guard intervals 206 and 207 to approximately the formation pressure (or a pressure between the formation pressure and the wellbore pressure) while the sample interval 205 is being drawn down to perform a pressure buildup test. In such an example, the pressure differential experienced by the inner packers 210 and 211 (see FIG. 3) is reduced to less than the pressure differential that would be experienced by the packers 210 and 211 were the outer packers 212 and 213 not present, inflated and/or implemented. In other examples, the pressure testing system 220 of FIG. 2 maintains the pressures in the guard intervals 206 and 207 to be substantially equal to (or having a fixed offset from) the pressure in the inner interval 205. By reducing and/or controlling the pressure differentials experienced by the inner packers 210 and 211, the inner packers 210 and 211 are less susceptible to mechanical instability (e.g., creeping, sliding and/or deformation), thereby improving the accuracy of the subsequent pressure buildup data. Moreover, because the example inner packers 210 and 211 of FIG. 2 are subjected to lower differential pressures they may be implemented using simpler packer structures (e.g. shorter packers, packers having less or none reinforcement structures such as cables, etc.). The use of shorter and/or simpler packer structures may be advantageous to reduce the overall length of the LWD module 200. Example manners of implementing the example pressure testing system 220 of FIG. 2 is described below in connection with FIGS. 3 and 5.

The example pressure testing system 220 of FIG. 2 is also fluidly coupled to a port 228 located below the example outer packer 213. The example port 228 of FIG. 2 is directly exposed to the fluid(s) present in the wellbore 11. The example port 228 may, alternatively, be located above the example outer packer 212. Moreover, the port 228 may be fluidly coupled to an additional port (not shown) located above the packer 212 via a bypass flowline of the LWD module 200 (not shown). Among other things, the example port 228 of FIG. 2 can be used to balance the pressure of the portion of the wellbore 11 located above the packer 212 with the pressure of the portion of the wellbore 11 located below the packer 213, and/or to allow fluid to be moved between any of the intervals 206-207 and the wellbore 11 via a bypass flowline of the LWD module 200 (not shown).

In some examples, one or more probes (not shown) having pretest capabilities may be implemented to perform formation pressure and/or mobility measurements in one or more of the intervals 206 and 207, below the example outer packer 213 and/or above the example outer packer 212. Such probes may be used to obtain values representative of formation parameters in a substantially shorter time period than when using a packer interval. Formation parameter values obtained with the probe(s) may be used by example pressure testing system 220 for example to maintain the pressures in the guard intervals 206 and 207 to be substantially equal to (or having a fixed offset from) the formation pressure. Example probes and methods to use the same are described in U.S. Pat. No. 7,031,841, entitled "Method for Determining Pressure of Earth Formations," and issued on Apr. 18, 2006; and in U.S. Pat. No. 6,986,282, entitled "Method and Apparatus for Determining Downhole Pressures during a Drilling Operation," and issued on Jan. 17, 2006. U.S. Pat. Nos. 7,031,841, and 6,986,282 are hereby incorporated by reference in their entireties.

Additionally or alternatively, pressure values obtained with the probe(s) may be used to determine propagation properties of pressure pulses in the formation. Example manners of determining propagation properties of pressure pulses in the formation are taught for example in U.S. Pat. No. 4,936,139, entitled "Downhole Method for Determination of Formation Properties," and issued on Jun. 26, 1990.

Figure 3:
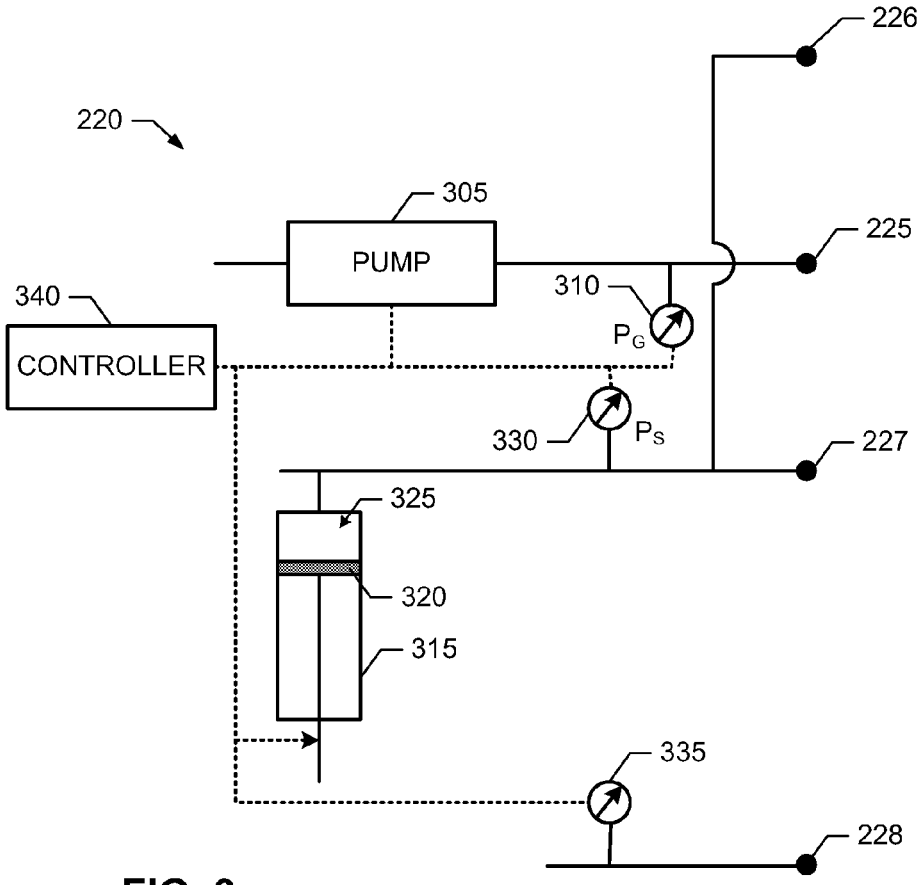
FIG. 3 illustrates an example manner of implementing the pressure testing system of FIG. 2.
Figure 4:
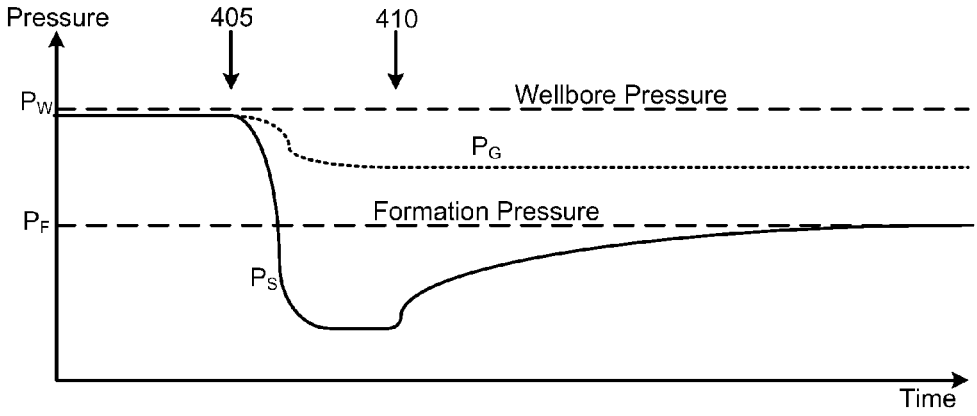
FIG. 4 is a graph characterizing an example operation of the example pumping system of FIG. 2.

FIG. 3 illustrates an example manner of implementing the example pressure testing system 220 of FIG. 2. To pump fluid from the inner interval 205 via the port 225, the example pressure testing system 220 of FIG. 2 includes any type of pump 305. When activated, the example pump 305 of FIG. 3 pumps fluid from the port 225 into, for example, a sample container and/or bottle, the wellbore 11 (e.g., via a bypass flowline (not shown)), and/or a fluid analysis module. As shown in FIG. 4, the example pump 305 may be used to pump fluid from the inner interval 205 to drawdown the pressure $P_S$ of the inner interval 205 to initiate a pressure buildup test. In the example of FIG. 4, the inner interval pressure $P_S$ is reduced by the pump 305 to a pressure that is less than the formation pressure $P_F$. In some examples, the pump 305 operates until a specified amount of reservoir fluid has been pumped. Additionally or alternatively, the pump 305 operates until the drawdown pressure is reached, the pump 305 is stopped, and the inner interval pressure $P_S$ is measured while it builds backup towards the formation pressure $P_F$, and while the volume(s) of any flowlines and/or chambers fluidly coupled to the port 225 are held constant. To measure the inner interval pressure $P_S$, the example pressure testing system 220 of FIG. 2 includes any type of pressure gauge 310.

To adjust the pressure in the guard intervals 206 and 207, the example pressure testing system 220 of FIG. 3 includes any type of pump 315. The example pump 315 of FIG. 3 is controllable to pump fluid into and/or out of the guard intervals 206 and 207 to increase and/or decrease the pressure in the guard intervals 206 and 207, respectively. An example pump 315 includes a hydraulic piston 320 to adjust the volume in a chamber 325 fluidly coupled to the ports 226 and 227. To measure the pressure $P_G$ of the guard intervals 206 and 207, the example pressure testing system 220 of FIG. 2 includes any type of pressure gauge 330. To measure the pressure $P_W$ of the wellbore 11, the example pressure testing system 220 of FIG. 2 includes any type of pressure gauge 335. In some examples, a single pump is used to implement the pump 305 and the pump 315.

To perform a pressure buildup test, the example pressure testing system 220 of FIG. 3 includes a controller 340. The example controller 340 of FIG. 3 controls the example pump 305 and piston 320 to initiate a pressure buildup test, and measures the pressure in the inner interval 205 during the subsequent pressure buildup phase via the example pressure gauge 310. The example controller 340 also controls the inflation and deflation of the example packers 210-213. The example controller 340 of FIG. 3 is implemented by any type of general-purpose processor, processor core, and/or microcontroller. Alternatively, the example controller 340 may be implemented by one or more circuit(s), programmable processor(s), application specific integrated circuit(s) (ASIC(s)), programmable logic device(s) (PLD(s)) and/or field programmable logic device(s) (FPLD(s)), etc., and/or any combination of hardware, firmware and/or software.

As shown in FIG. 4, at a time 405 the example controller 340 (FIG. 3) activates the pump 305 to reduce the inner interval pressure $P_S$ from the wellbore pressure $P_W$ to a pressure less than the formation pressure $P_F$. While the inner interval pressure $P_S$ is being reduced, the example controller 340 adjusts the position of the piston 320 to adjust the guard interval pressure $P_G$ to a desired and/or target pressure. The guard interval pressure $P_G$ may be adjusted in accordance with any number of pressure management strategies. For example, the guard interval pressure $P_G$ may be reduced to the formation pressure $P_F$ (e.g. estimated from a measurement performed by a probe). In such an example, the pressure differentials experienced by each of the inner packers 210 and 211 is substantially zero at the end of the pressure buildup test, while the pressure differentials experienced by the outer packers 212 and 213 are substantially the difference between the wellbore pressure $P_W$ and the formation pressure $P_F$ at the end of the pressure buildup test. In another example, the guard interval pressure $P_G$ is adjusted to a pressure between the wellbore pressure $P_W$ and the formation pressure $P_F$ to distribute the pressure difference across the inner packers 210 and 211 and the outer packers 212 and 213. In such an example, the example LWD module 200 can operate in a wellbore having a higher hydrostatic pressure to drawdown pressure difference than can be withstood by a single pair of inner packers 210 and 211 and/or the pump 305. The example controller 340 can determine how much to reduce the pressure $P_G$ of the guard intervals 206 and 207 based on the wellbore pressure $P_W$ measured by the pressure gauge 335 and a desired drawdown pressure. For example, for a large wellbore to drawdown pressure difference, the example controller 340 distributes the pressure difference across the outer packers 212 and 213 and the inner packers 210 and 211. Otherwise, the example controller 340 adjusts the guard interval pressure $P_G$ to be substantially equal to the formation pressure $P_F$.

When, at time 410, the drawdown pressure has been reached and the guard interval pressure $P_G$ adjusted, the controller 340 starts measuring pressure buildup data in the inner interval 205 using the pressure gauge 310.

Figure 5:
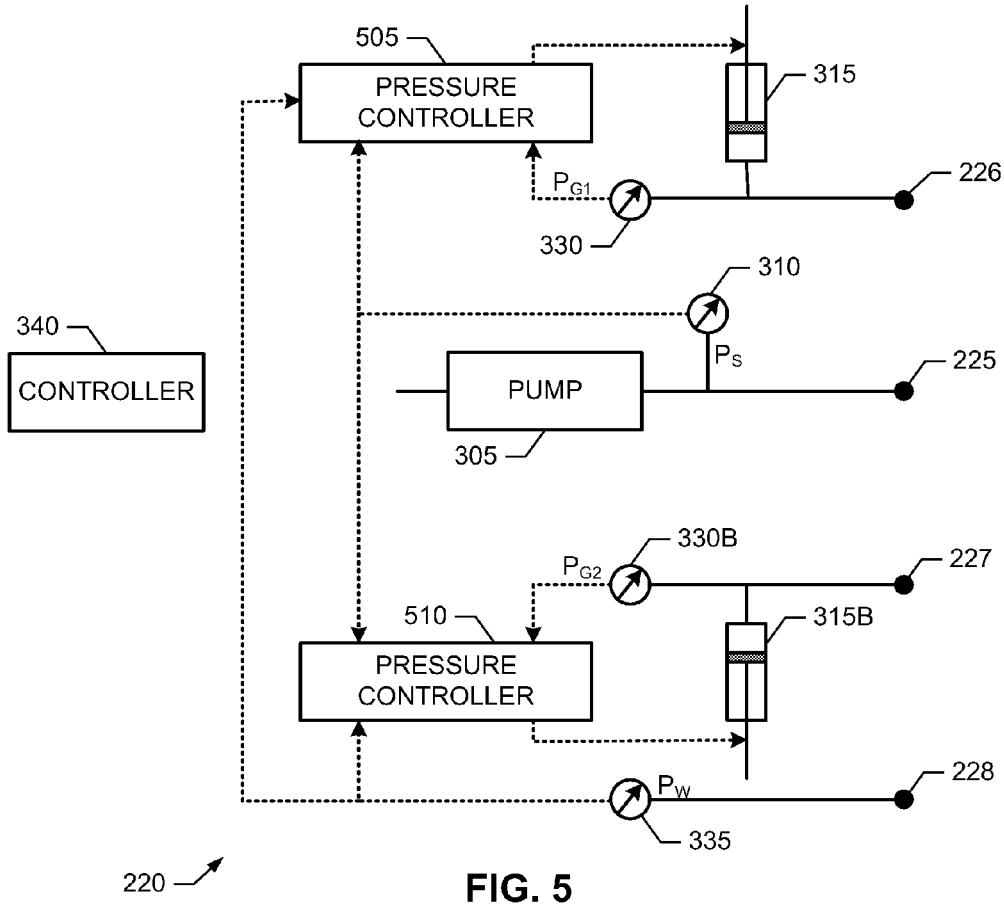
FIG. 5 illustrates another example manner of implementing the pressure testing system of FIG. 2.

FIG. 5 illustrates another example manner of implementing the example pressure testing system 220 of FIG. 2. Because elements of the example pressure testing system 220 of FIG. 5 are similar or identical to those discussed above in connection with FIG. 3, the descriptions of those similar or identical elements are not repeated here. Instead, similar or identical elements are illustrated with identical reference numerals in FIGS. 3 and 5, and the interested reader is referred back to the descriptions presented above in connection with FIG. 3 for a complete description of those like numbered elements.

In contrast to the example pressure testing system 220 of FIG. 3, the example pressure testing system 220 of FIG. 5 includes pressure controllers 505 and 510 for respective ones of the guard intervals 206 and 207. The example pressure controller 505 of FIG. 5 actively controls the pump 315 to maintain the guard interval pressure $P_{G1}$ of the guard interval 206 based on the inner interval pressure $P_S$ and the wellbore pressure $P_W$. For example, the pressure controller 505 adapts and/or maintains the guard interval pressure $P_{G1}$ to be substantially equal to the inner interval pressure $P_S$ to reduce the mechanical stresses experienced by the inner packer 210. When the wellbore to drawdown pressure difference is large, the example controller 505 adapts the guard interval pressure $P_{G1}$ to distribute the pressure difference between the outer packer 212 and the inner packer 210. The pressure $P_{G1}$ of the guard interval 206 is measured by the example pressure gauge 330.

Likewise, the example pressure controller 510 of FIG. 5 actively controls a pump 315B, which is substantially identical to the example pump 315, to maintain the guard interval pressure $P_{G2}$ of the second guard interval 207 based on the inner interval pressure $P_S$ and the wellbore pressure $P_W$. The pressure $P_{G2}$ of the guard interval 207 is measured by a pressure gauge 330B, which is substantially identical to the pressure gauge 330. While in some examples, the pressures $P_{G1}$ and $P_{G1}$ are maintained at substantially the same pressure, the pressures $P_{G1}$ and $P_{G1}$ may be maintained at different pressures. For example, independent control of the pressure $P_{G1}$ in the first guard interval 206 and the pressure $P_{G2}$ in the second guard interval 207 may be beneficial when one of the outer packers 212, 213 experiences mechanical instability (e.g., creeping, sliding and/or deformation). In such circumstances, the pressure in the corresponding guard intervals 206 or 207 may require adjustment to minimize the impact of the mechanical instability of the outer packer 212, 213 on the pressure $P_G$ in the testing interval 205.

The example pressure controllers 505 and 510 of FIG. 5 are implemented by any type of general-purpose processor, processor core, and/or microcontroller. Alternatively, the example pressure controllers 505 and 510 may be implemented by one or more circuit(s), programmable processor (s), ASIC(s), PLD(s) and/or FPLD(s), etc., and/or any combination of hardware, firmware and/or software.

In addition to controlling the example pump 305 and measuring the pressure buildup data via the example pressure gauge 310, as described above in connection with FIGS. 3 and 4, the example controller 340 of FIG. 5 activates and/or deactivates the pressure controllers 505 and 510.

While example manners of implementing the example pressure testing system 220 of FIG. 2 have been illustrated in FIGS. 3 and 5, one or more of the elements, controllers and/or devices illustrated in FIGS. 3 and/or 5 may be combined, divided, re-arranged, omitted, eliminated, and/or implemented in any other way. For example, the example pressure controller 505 could be implemented in the example pressure control system 220 of FIG. 2 to adapt, control and/or maintain the pressure in both of the guard intervals 206 and 207 via the pump 315. Further, a pressure testing system and/or LWD module may include elements, controllers and/or devices instead of, or in addition to, those illustrated in FIGS. 3 and/or 5, and/or may include more than one of any or all of the illustrated elements, controllers and/or devices.

Figure 6:
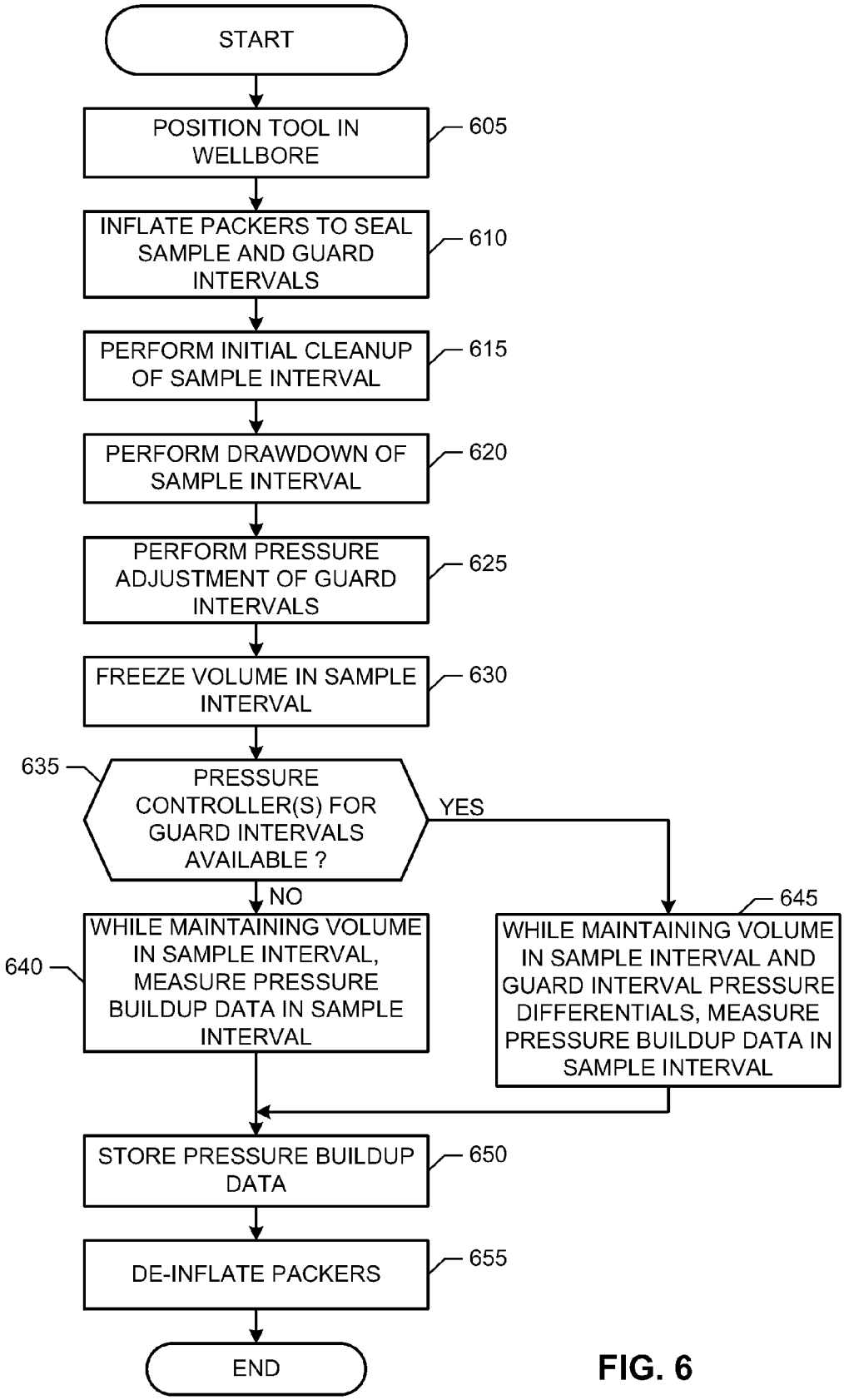
FIG. 6 is a flowchart of an example process that may be executed by, for example, a processor to perform pressure testing of a geological formation.

FIG. 6 illustrates an example process that may be carried out to perform pressure testing of a geological formation. The example process of FIG. 6 may be carried out by a processor, a controller and/or any other suitable processing device. For example, the process of FIG. 6 may be embodied in coded instructions stored on a tangible machine and/or computer-readable medium such as a flash memory, a CD, a DVD, a floppy disk, a read-only memory (ROM), a random-access memory (RAM), a programmable ROM (PROM), an electronically-programmable ROM (EPROM), and/or an electronically-erasable PROM (EEPROM), an optical storage disk, an optical storage device, a magnetic storage disk, a magnetic storage device, and/or any other tangible medium, which can be accessed, read and/or executed by a processor, a general purpose or special purpose computer or other machine with a processor (e.g., the example processor platform P100 discussed below in connection with FIG. 7). Alternatively, some or all of the example process of FIG. 6 may be implemented using any combination(s) of circuit(s), ASIC(s), PLD(s), FPLD(s), discrete logic, hardware, firmware, etc. Also, some or all of the example process of FIG. 6 may be implemented manually or as any combination of any of the foregoing techniques, for example, any combination of firmware, software, discrete logic and/or hardware. Further, although the example operations of FIG. 6 are described with reference to the flowchart of FIG. 6, many other methods of implementing the operations of FIG. 6 may be employed. For example, the order of execution of the blocks may be changed, and/or one or more of the blocks described may be changed, eliminated, sub-divided, or combined. Additionally, any or all of the example process of FIG. 6 may be carried out sequentially and/or carried out in parallel by, for example, separate processing threads, processors, devices, discrete logic, circuits, etc.

The example process of FIG. 6 begins with the example LWD module 200 of FIG. 2 being positioned in a wellbore (block 605). The example controller 340 (FIGS. 3 and 5) inflates the packers 210-213 to seal and/or form the intervals 205-207 (block 610). In some examples, the inner packers 210 and 211 are inflated prior to the outer packers 212 and 213, however, all of the packers 210-213 may alternatively be inflated essentially simultaneously.

In some examples, the controller 340 collects pressure data to estimate the wellbore pressure $P_W$ and the formation pressure $P_F$. For example, the wellbore pressure $P_W$ may be obtained via the pressure sensor 335 (FIGS. 3 and 5), and the controller 340 may initiate a pretest using a probe (not shown) to estimate the formation pressure $P_F$. In other examples, prior knowledge of the formation F (e.g. from a remotely performed pressure test, a pressure gradient, etc.) are used estimate the formation pressure $P_F$.

The controller 340 activates the pump 305 to, for example, perform initial cleanup, and/or mudcake removal in the inner interval 205 (block 615). In some example implementations, such as when no formation pressure estimate has been obtained otherwise, a formation pressure estimation may also be obtained at block 615 by detecting a mudcake breach and/or by permitting the pressure $P_S$ in the interval 205 to stabilize after mudcake removal.

The controller 340 activates the pump 305 to drawdown the pressure $P_S$ of the inner interval 205 (block 620). At substantially the same time, the controller 340 of FIG. 35 controls the pump 315 or activates the pressure controllers 505 and 510 (FIG. 5) to adjust, set and/or otherwise reduce the pressures $P_{G1}$ and/or $P_{G2}$ of the guard intervals 206 and 207 (block 625). Alternatively, if the pressure testing system 220 of FIG. 3 is being used, at block 625 the example controller 340 controls the pump 315 to adjust, set and/or otherwise reduce the pressure $P_G$ of the guard intervals 206 and 207. In some cases, the pressures $P_{G1}$ and/or $P_{G2}$ (or the pressure $P_G$) are controlled based on an estimate of the formation pressure $P_F$, as well as the wellbore pressure $P_W$. In particular, the pressures $P_{G1}$ and/or $P_{G2}$ (or the pressure $P_G$) are preferably maintained above the formation pressure $P_F$ in order to minimize the risk of establishing a hydraulic communication between one of the outer intervals 206 or 207 and the formation F (FIG. 2), which could have negative effect on the quality of the pressure buildup data and their interpretation. The drawdown and the guard interval pressure reductions may be performed in parallel to maintain the mechanical stability of the inner packers 210-211. The controller 340 then freezes and/or fixes the volume of any flowlines and/or chambers fluidly coupled to the sample interval 205 (block 630).

If the pressure controllers 505, 510 are not available for the guard intervals 206 and 207 (block 635), the controller 340 measures the pressure buildup data using the pressure gauge 310, see FIG. 3 (block 640). If there are pressure controllers 505, 510 available for the guard intervals 206 and 207 (block 635), the controller 340 measures the pressure buildup data using the pressure gauge 310 while the pressure controllers 505, 510 maintain the guard interval pressures $P_{G1}$ and $P_{G2}$, see FIG. 5 (block 645).

When the pressure buildup test is complete, the controller 340 stores the measured pressure buildup data (block 650), and de-activates the pressure controllers 505 and 510 (if present) and deflates the packers (block 655). Control then exits from the example process of FIG. 6. Alternatively, at block 610 only the inner packers 210 and 211 are inflated. After the initial cleanup is performed at block 615, the outer packers 212 and 213 are inflated.

Figure 7:
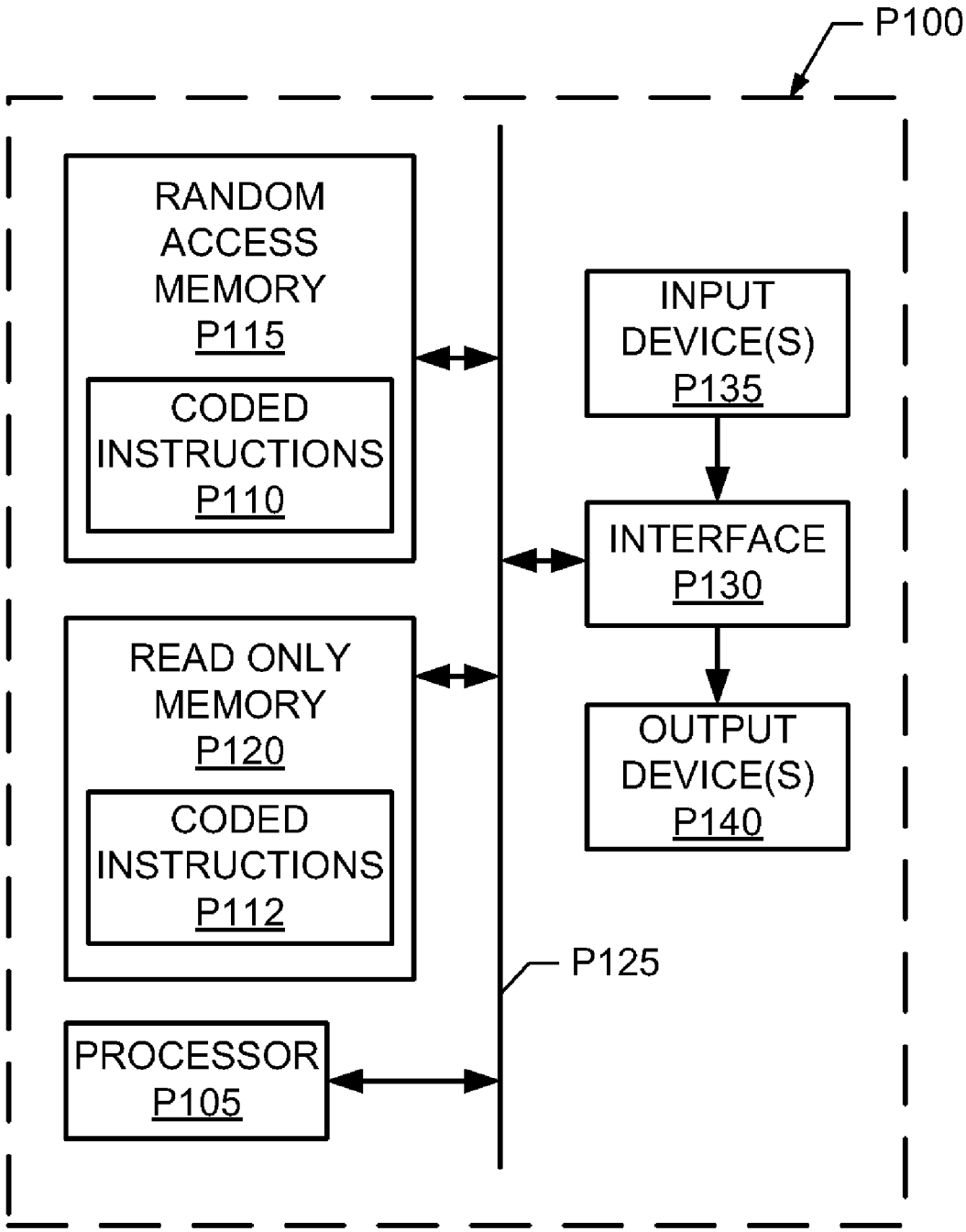
FIG. 7 is a schematic illustration of an example processor platform that may be used and/or programmed to carry out the example process of FIG. 6 to implement any of all of the example methods and apparatus described herein.

FIG. 7 is a schematic diagram of an example processor platform P100 that may be used and/or programmed to implement any or all of the example methods and apparatus disclosed herein. For example, the processor platform P100 can be implemented by one or more general-purpose processors, processor cores, microcontrollers, etc.

The processor platform P100 of the example of FIG. 7 includes at least one general-purpose programmable processor P105. The processor P105 executes coded instructions P110 and/or P112 present in main memory of the processor P105 (e.g., within a RAM P115 and/or a ROM P120). The processor P105 may be any type of processing unit, such as a processor core, a processor and/or a microcontroller. The processor P105 may execute, among other things, the example process of FIG. 6 to perform pressure testing of a geological formation.

The processor P105 is in communication with the main memory (including a ROM P120 and/or the RAM P115) via a bus P125. The RAM P115 may be implemented by dynamic random-access memory (DRAM), synchronous dynamic random-access memory (SDRAM), and/or any other type of RAM device(s), and ROM may be implemented by flash memory, EPROM, EEPROM, a CD, a DVD and/or any other desired type of memory device(s). Access to the memory P115 and the memory P120 may be controlled by a memory controller (not shown). The memory P115 may be used to store pressure buildup data.

The processor platform P100 also includes an interface circuit P130. The interface circuit P130 may be implemented by any type of interface standard, such as an external memory interface, serial port, general-purpose input/output, etc. One or more input devices P135 and one or more output devices P140 are connected to the interface circuit P130. The input devices P135 may be used to collect and/or receive pressure data from a pressure gauge. The output devices P140 may be use to control and/or activate a pump.

Although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. A method for pressure testing a geological formation comprising:

positioning a testing tool in a wellbore formed in the geological formation;

sealing a sample interval around the testing tool;

sealing a first guard interval around the testing tool and adjacent to the sample interval;

reducing a first pressure in the sample interval;

reducing a second pressure in the first guard interval;

maintaining a volume of a first chamber fluidly coupled to the sample interval during a time interval; and measuring a plurality of pressure data for a fluid captured in the first chamber during the time interval.

2. A method as defined in claim 1, further comprising actuating a pump fluidly coupled to the sample interval to perform a cleanup operation and to reduce the first pressure to a drawdown pressure.

3. A method as defined in claim 1, wherein sealing the sample interval comprises extending first and second packers around the testing tool, and wherein sealing the first guard interval comprises extending a third packer around the testing tool, the first guard interval formed by the second and third packers.

4. A method as defined in claim 1, further comprising:

sealing a second guard interval around the testing tool and adjacent to the sample interval; and reducing a third pressure in the second guard interval.

5. A method as defined in claim 1, wherein the second pressure is reduced to substantially a formation pressure.

6. A method as defined in claim 1, wherein the second pressure is less than a wellbore pressure and greater than a formation pressure to mechanically stabilize the sample interval.

7. A method as defined in claim 1, further comprising maintaining the second pressure in the first guard interval during the time interval.

8. A method as defined in claim 1, further comprising actuating a pump fluidly coupled to the first guard interval to reduce the second pressure.

9. A method as defined in claim 8, wherein the pump comprises a variable-volume second chamber.

10. A method as defined in claim 1, further comprising maintaining a pressure difference between the sample interval and the first guard interval during the time interval.

11. A method as defined in claim 10, wherein the pressure difference is maintained at substantially zero.

12. A downhole tool for pressure testing a geological formation, the tool comprising:

first and second packers to form an inner interval around the testing tool;

a third packer to seal a first outer interval around the testing tool adjacent to the inner interval;

a first pump to reduce a first pressure in the inner interval;

a second pump to reduce a second pressure in the first outer interval; and a pressure gauge to measure a plurality of pressure data for a fluid captured in the inner interval while the second pressure is reduced and a volume of the inner interval is maintained.

13. A downhole tool as defined in claim 12, further comprising:

a fourth packer to seal a second outer interval around the testing tool adjacent to the inner interval, the second outer interval located on an opposite of the inner interval from the first outer interval;

a third pump to reduce a third pressure in the second outer interval.

14. A downhole tool as defined in claim 12, wherein the first pump is to perform a cleanup operation and to reduce the first pressure to a drawdown pressure.

15. A downhole tool as defined in claim 12, wherein the second pressure is reduced to substantially a formation pressure.

16. A downhole tool as defined in claim 12, wherein the second pressure is reduced to less than a wellbore pressure and greater than a formation pressure to increase a mechanical stability of the first and second packers.

17. A downhole tool as defined in claim 12, wherein the first pump comprises the second pump.

18. A downhole tool as defined in claim 12, wherein the second pump comprises a variable-volume second chamber.

19. A downhole tool as defined in claim 18, further comprising a pressure controller to maintain the second pressure in the first outer interval while the plurality of pressure data is measured.

20. A downhole tool as defined in claim 12, further comprising a pressure controller to maintain a pressure difference between the inner interval and the first outer interval while the plurality of pressure data is measured.

21. A downhole tool as defined in claim 20, wherein the pressure controller maintains the pressure difference at substantially zero.

* * * * *